US012648605B2

(12) United States Patent
Cooper

(10) Patent No.: US 12,648,605 B2
(45) Date of Patent: Jun. 9, 2026

(54) ROLLABLE BASEBALL CAP

(71) Applicant: Levi Travis Cooper, Los Angeles, CA (US)

(72) Inventor: Levi Travis Cooper, Los Angeles, CA (US)

( * ) Notice: Subject to any disclaimer, the term of this patent is extended or adjusted under 35 U.S.C. 154(b) by 0 days.

(21) Appl. No.: 19/019,100

(22) Filed: Jan. 13, 2025

(65) Prior Publication Data

US 2025/0228321 A1 Jul. 17, 2025

Related U.S. Application Data

(60) Provisional application No. 63/620,635, filed on Jan. 12, 2024.

(51) Int. Cl.
*A42B 1/201* (2021.01)
*A42B 1/0183* (2021.01)
*A42B 1/22* (2006.01)

(52) U.S. Cl.
CPC ..... *A42B 1/201* (2013.01); *A42B 1/0183* (2021.01); *A42B 1/22* (2013.01)

(58) Field of Classification Search
CPC ..... A42B 1/0184; A42B 1/14; A42B 1/004; A42B 1/22; A42B 1/0183; A42B 1/201
See application file for complete search history.

(56) References Cited

U.S. PATENT DOCUMENTS 2,038,875 A * 4/1936 Siegelbaum ..... A42C 1/06 2/175.5
6,088,837 A * 7/2000 Baker ..... A61F 9/045 2/10
6,311,331 B1 * 11/2001 Park ..... A42C 5/00 2/209.12
8,024,818 B1 * 9/2011 Davenport ..... A42B 1/0187 2/172
2004/0123376 A1 * 7/2004 Wang ..... A42B 1/0183 2/171.1
2018/0146734 A1 * 5/2018 Kelly ..... A42B 1/004
2022/0125145 A1 * 4/2022 Welborn ..... A42B 1/0183

* cited by examiner

*Primary Examiner* — Alissa L Hoey
*Assistant Examiner* — Akwokwo Olabisi Redhead
(74) *Attorney, Agent, or Firm* — Buchalter LLP

(57) ABSTRACT

A cap includes a crown; and a bill comprising one of a bistable spring sheet or a plurality of bistable springs; wherein, in a first position of the cap, the one of the bistable spring sheet or the plurality of bistable springs are unrolled and the bill is in an extended configuration, and in a second position of the cap, the one of the bistable spring sheet or the plurality of bistable springs are rolled up and the bill is in a rolled configuration.

11 Claims, 17 Drawing Sheets

ROLLABLE BASEBALL CAP

BACKGROUND

The nature of a baseball-style cap is to fit securely on the user's head while supporting a bill in the front that offers sun protection. These caps are an awkward and inconvenient shape when they are not being worn. A hemispheric cap crown connects to the supported, rigid, protruding bill along a sweatband brim. Together the crown and bill retain the full shape of the cap when it is not in use. Even in cases where the cap crown is flexible, the bill is at risk of being bent or damaged if the cap is not stored in its normal configuration.

Existing attempts at providing a rollable cap with a rigid bill involve simply stuffing the malleable crown of the cap under a traditional brim that has been curled side to side along the natural curvature of the brim and secured by a rubber band. Because most baseball cap brims are made of a deformable material (often plastic or pressed paper products) covered in fabric, rolling the brim can cause permanent damage to the brim. Repeatedly rolling and unrolling existing caps is thus inconvenient and contributes to degradation of the cap.

Traditionally, the left and right sides of a rigid bill may be rolled or bent downward, following the natural curvature of the bill (i.e., side-to-side), in order to compact the shape enough to store the cap in a pocket or a bag. However, this practice rolls the bill of the cap past the designed curve threshold and leads to a high risk of causing damages to the bill. Also, the crown of the cap does not naturally roll within the bill when it is stored in this manner. Additionally, the cap will not stay in the rolled state without outside reinforcement, such as cords, rubber bands, etc.

One existing solution to this problem consists of a foldable cap, where the single-style cap is designed with pre-existing creases running lengthwise (front to back) on the brim, allowing the brim to fold along these lines. However, this design embraces the idea of a damaged brim by pre-damaging it as part of the original construction, causing intended flaws in the shape, stability, appearance, etc. Additionally, the cap may not stay in the folded state without outside reinforcement. Also the cap does not have the ability for dual-style wearability. Another existing solution to this problem consists of an uncrushable hat, where a single-style cap is manufactured of a flimsy, soft, flexible material with a memory recoil ability that allows the hat to be bent in different directions and still reform to its original shape. However, the bill structure form is not rigid and it does not hold a storable compact shape without outside reinforcement. Also the cap does not have the ability for dual-style wearability.

Furthermore, the bill of a generic baseball-style cap is usually covered in cloth that can be difficult to clean due to the rigid structure of the bill that is contained inside.

Another common issue with a traditional cap is the method of fitting the cap to the user's head. The options most commonly available are single-functional and consist of either a fitted cap that is not adjustable, which may or may not include a stretch-band sown inside along the inner sweatband brim of the cap, or the cap will have a single-functional, back-strapped, open section in the back that can adjusted by well-known methods such plastic bands, VELCRO® (i.e., hook and loop fasteners), etc.

Unfortunately, these common options either only have a single function, and/or always leave a gap at the back of the cap, and/or do not provide a cap that remains enclosed around the entire hemispheric surface and that is also adjustable in size.

SUMMARY

The present disclosure pertains to a baseball-style cap which can be converted into a compact rolled shape, particularly in reference to the cap's bill which can be formed of a series of bistable springs or a bistable spring sheet. By providing a bistable rollable bill, the cap is capable of being stored compactly, with the crown of the cap being contained within the cap in the rolled up configuration. Thus, the cap is easily stored when not in use. When in the unrolled configuration, the rollable bill is reformed into a traditional rigid bill shape which can be reliably repeated without deformation to the bill or any part of the cap.

The present disclosure provides a novel rollable cap comprising a bill constructed of a series of bistable springs or a bistable spring sheet. In contrast to traditional caps, which may be rolled side-to-side, the present cap provides the ability to roll the cap's bill against the natural curvature without compromising the bills integrity, while also utilizing the change in structure to more efficiently store the cap. The change in the cap's form also provides unique dual-style wearability while the cap is in use. In some embodiments, a dual function back-strap may be added to provide a novel manner of securing both the crown of the cap when it is in use and the rolled bill when it is not in use. In some embodiments, buttons or other similar fasteners may be added on the rear of the cap crown, providing a novel manner to adjust the size of the cap.

In one example embodiment described herein, the bill of the cap can be covered in or made of materials that are easy to clean, such as silicone. The present disclosure provides a cap that uses a bill constructed of a bistable spring metal sheet or bistable spring metal bands connected or secured into a synchronized position together to form the internal sheet structure of the bill. The bill may be coated in silicone or other suitable coating materials, which may also provide an improvement in flexibility and the ability to clean the bill. In some embodiments, the cap may also include a lengthened back-strap design for securing the fit of the cap's crown when it is in use with a unique configuration of insert holes to conceal any excess of the back-strap. This configuration is a multifunction design and will also uniquely secure the rolled form of the cap when it is being stored. In another embodiment, the cap may also include a larger fitted (gapless) crown with an integrated stretch-band and securing buttons on the outer edges.

The cap of the present disclosure permits users to roll back the front and back ends of the bill upward against the original natural curvature, which will pop the internal bistable spring sheet of the bill into the rolled-up state with easily accessible space inside the rolled bill to fit the remaining cap portion of the cap when it is not in use and to provide dual-style wearability when it is in use. In some embodiments, the cap may be secured in the back when in use by using a lengthened back-strap configuration including a series of uniquely positioned, weaving-ready insert holes, and the cap can be secured in the rolled position when not in use via a secondary functional design of this back-strap configuration. In other embodiments, the cap may be secured in the back using a series of fasteners (buttons, snaps, etc.) that will snap over onto each other with an integrated stretch-band brim of the cap that folds over on itself to give the cap the ability to fasten into a tighter fit without the need of an opening in the back of the brim.

Disclosed is a cap comprising a crown; and a bill comprising one of a bistable spring sheet or a plurality of bistable springs; wherein, in a first position of the cap, the one of the bistable spring sheet or the plurality of bistable springs are unrolled and the bill is in an extended configuration, and in a second position of the cap, the one of the bistable spring sheet or the plurality of bistable springs are rolled up and the bill is in a rolled configuration.

Also disclosed is a method of forming a bill of a cap, the method comprising treating a piece of sheet metal to form a bistable spring sheet; and trimming the bistable spring sheet to form a continuously outer curved edge of the bistable spring sheet, wherein the bistable spring sheet can form the bill.

Additionally, disclosed is a method of forming a cap, the method comprising treating a piece of sheet metal to form a bistable spring sheet; trimming the bistable spring sheet to form a bill from the bistable spring sheet; and attaching the bill to a crown to form the cap.

These and other embodiments of the present disclosure will become apparent to those skilled in the art from a consideration of the following detailed description taken in combination with the accompanying drawings and by the elements, features, and combinations particularly pointed out in the claims. Although the terms "baseball cap" and "baseball-style cap" are used in this description, it should be understood that the cap is not limited to use while playing any particular sport, but is adaptable to be used with any number of suitable hat or cap shapes.

BRIEF DESCRIPTION OF THE DRAWINGS

Exemplary embodiments will be described and explained with additional details through the use of the accompanying drawings.

DETAILED DESCRIPTION OF THE INVENTION

The present disclosure relates to a rollable cap that can use a single bistable spring sheet or a series of bistable springs in a bill of the cap to allow the cap to be rolled against the natural curvature of the cap. By rolling the cap bill, the entire cap can be stored in a compact configuration without damaging the bill, the crown, or any other part of the cap. And by rolling the cap bill, the cap can be worn in a secondary structured style with the bill in either the unrolled or rolled form.

Example aspects of a bistable spring can provide two stable states, and can be typically made of a metal such as steel. A commonly known bistable spring is a "slap bracelet" that in one state is a straight, rigid, elongate shape several inches long. The user can then slap the bracelet on their wrist, "popping" the bistable spring into the second state in which the spring is in a stable coiled or rolled state. The bistable spring will thus stay in either shape (elongate or rolled) until acted upon by an outside force to cause the spring to change to the other stable state.

The present disclosure takes advantage of the multiple stable or bistable states to provide a bill that in one state resembles a traditional baseball cap bill, and in the other state, rolls up onto itself. To transition from the first, unrolled state to the second, rolled state, the user can roll back the front) end (or front and back ends) of the bill upward perpendicular to the original natural curvature, which will pop the internal sheet of bistable springs into the secondary rolled-up state. In the rolled state, the cap can have easily accessible space inside the rolled bill to fit the remaining crown portion of the cap therein. In some embodiments, uniquely positioned, weaving-ready back-strap insert holes may be added on the rear of the cap to provide a novel manner of concealing any excess of the top back-strap. In this embodiment, the top back-strap may be lengthened to be multi-utilized. In addition to securing the fit of the cap's crown when it is in use, the top strap can also be interlaced through the main back-strap insert hole and then the back-strap can easily wrap around and secure a tighter close of the rolled bill when in the rolled position. The back-strap may be secured using a variety of fastening methods including, but not limited to, VELCRO® (i.e., hook and loop fasteners), snaps, slides, etc. In another embodiment, the cap may be secured in the back using a series of fasteners (buttons, snaps, etc.) that will snap over onto each other with an integrated stretch-band brim of the cap that folds over on itself to give the cap the ability to fasten into a tighter fit without the need of an opening in the back of the brim.

Figure 1A:
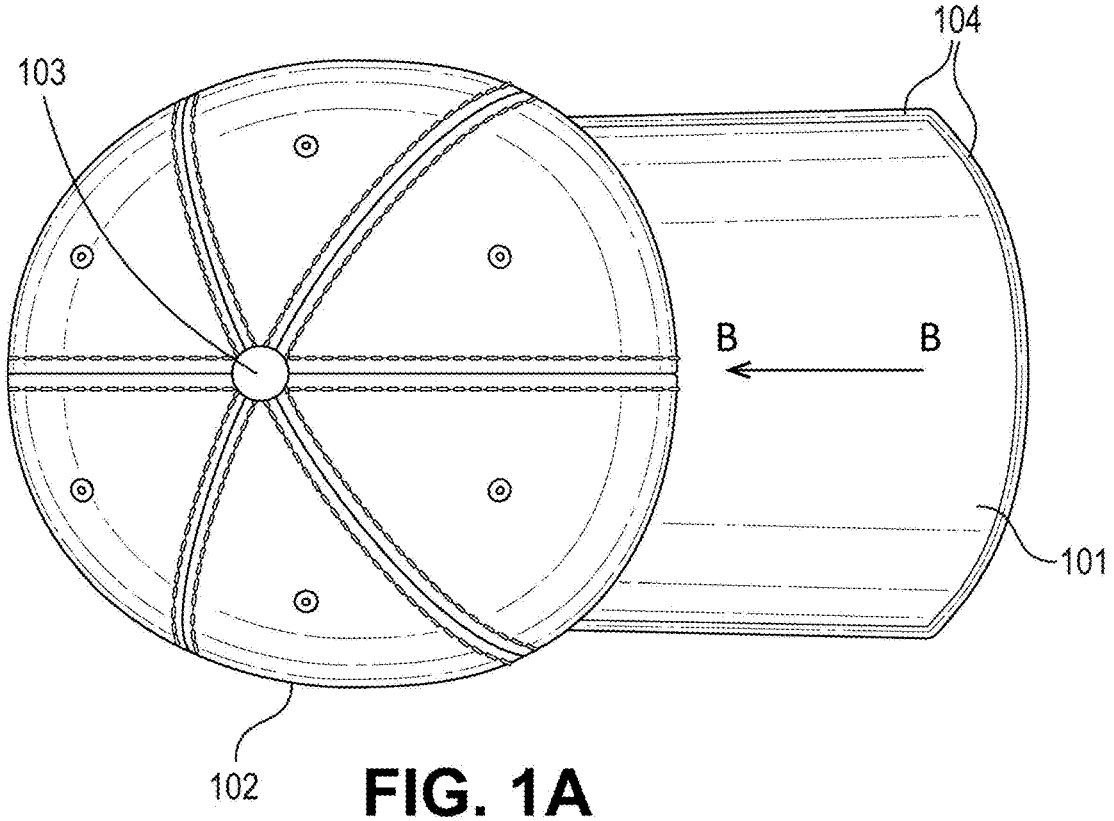
FIG. 1A illustrates a top view of a first embodiment of a cap in an unrolled or standard cap configuration.

Referring to FIG. 1A, example aspects of the cap can resemble a traditional baseball-style cap comprising having a bill 101 and a crown 102. As used throughout this disclosure, the bill 101 is the portion of the cap that extends outward away from the wearer's forehead when worn. The crown 102 is intended to refer to the part of the cap that fits over and around the wearer's head-typically, but not always, shaped as a half-dome. The crown 102 may be comprised of one or more panels. The cap may also be comprised of traditional components such as a top button 103, eyelets, sweatbands, decorative patches, etc. These additional components are compatible with the caps of the current disclosure but are not critical to the cap unless otherwise stated. The crown 102 may typically be comprised of cloth, but may also be made out of any wearable material compatible with the current cap.

In one embodiment, the cap can comprise one or more bistable springs, which may be covered with a protective edging 104, such as rubber tubing, fabric, flexible plastic, etc., to protect against sharp edges on the bistable springs. The edging 104 can thus protect against discomfort to the wearer and can protect against edges of the bistable springs wearing through the coating material covering the bill 101.

In the embodiment shown in FIGS. 1A-2B, the cap can be an adjustable cap comprising a hook-and-loop fastener for cap size adjustment. It will be understood that other commonly used single-function adjustable cap styles, such as those that employ VELCRO® (i.e., hook and loop fasteners), snaps, slides, etc., as well as fitted (non-adjustable) caps may also be used with the caps described herein without significant modification to the embodiment described in FIG. 1A-2B.

Figure 1B:
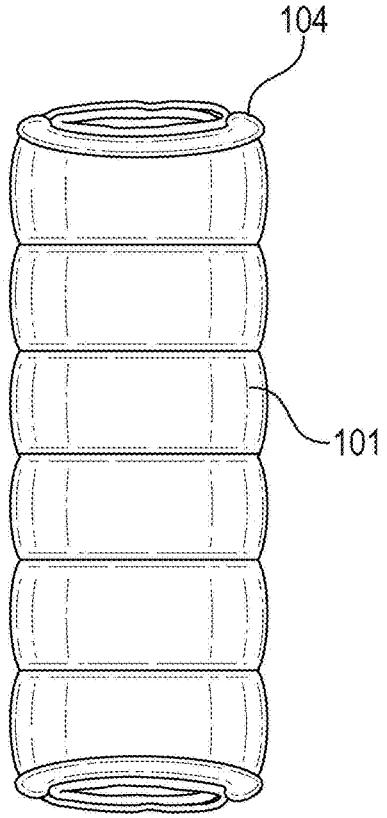
FIG. 1B illustrates a top view of the cap of FIG. 1 in a rolled configuration.

FIG. 1B shows the cap of the embodiment of FIG. 1A in the second, rolled state. Here, the bill 101 has been rolled in the direction indicated by line B-B in FIG. 1A-front to back in the direction of the bill 101, rather than side-to-side in the natural direction of curvature of the bill 101. The side edging 104 is visible in the rolled state.

Figure 2A:
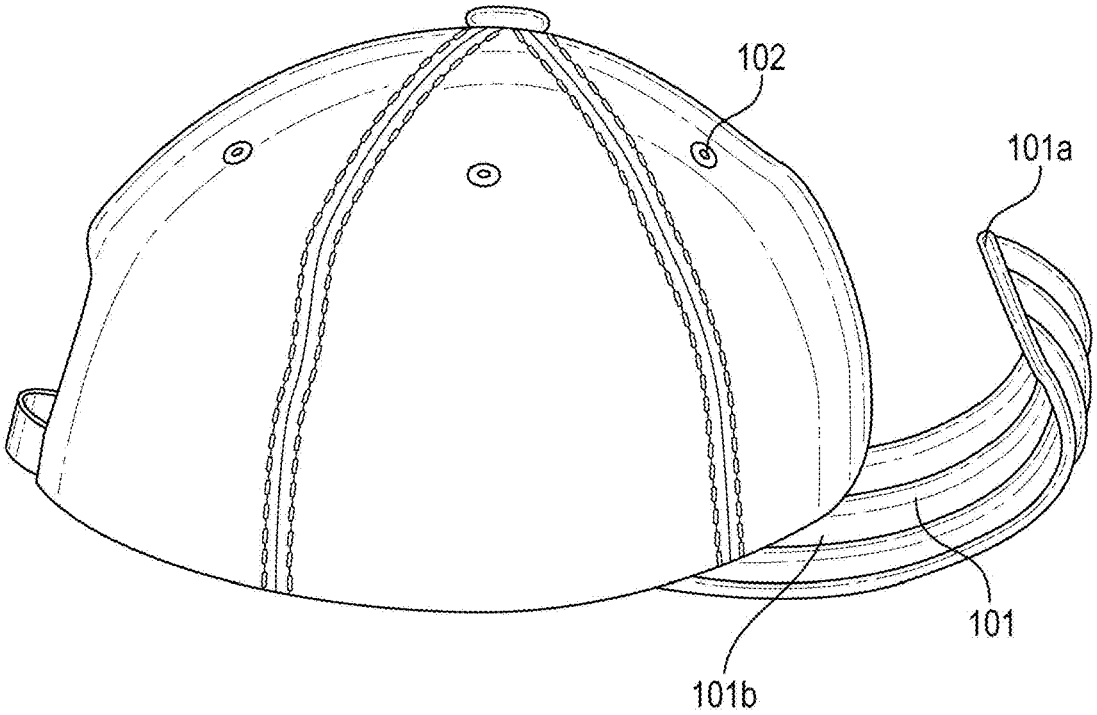
FIGS. 2A and 2B illustrate opposing side views of the cap of FIG. 1 in a partially rolled configuration.
Figure 2B:
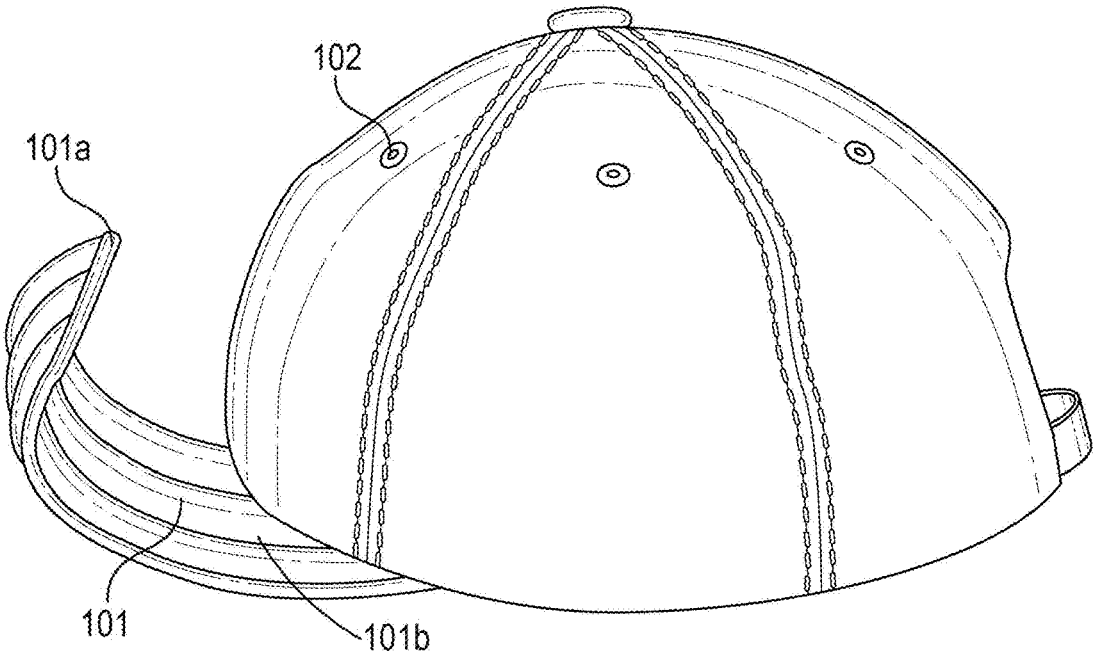

FIGS. 2A and 2B provide opposing side views of the cap as it is in the process of being converted from the first state (unrolled) to the second state (rolled). As seen, a front edge 101*a* of the bill 101 can be curled upward from front to back to pop the bistable springs in the bill 101 into the second state. The wearer of the cap may also begin by curling a back edge 101*b* of the bill 101 upward and toward the front of the bill 101. In one example embodiment, the bill 101 can rolled upward so that the crown 102 can fit easily into the rolled interior space of the bill 101. In another embodiment, the bistable spring sheet or bistable springs may be mounted upside-down (in relation to the previous embodiment) such that the user may roll the front and/or back of the bill 101 downward. In other embodiments, the bistable spring sheet or bistable springs may roll in a horizontal direction in relation to the cap's crown 102, instead of the previously described perpendicular direction in relation to the cap's crown 102.

Figure 3A:
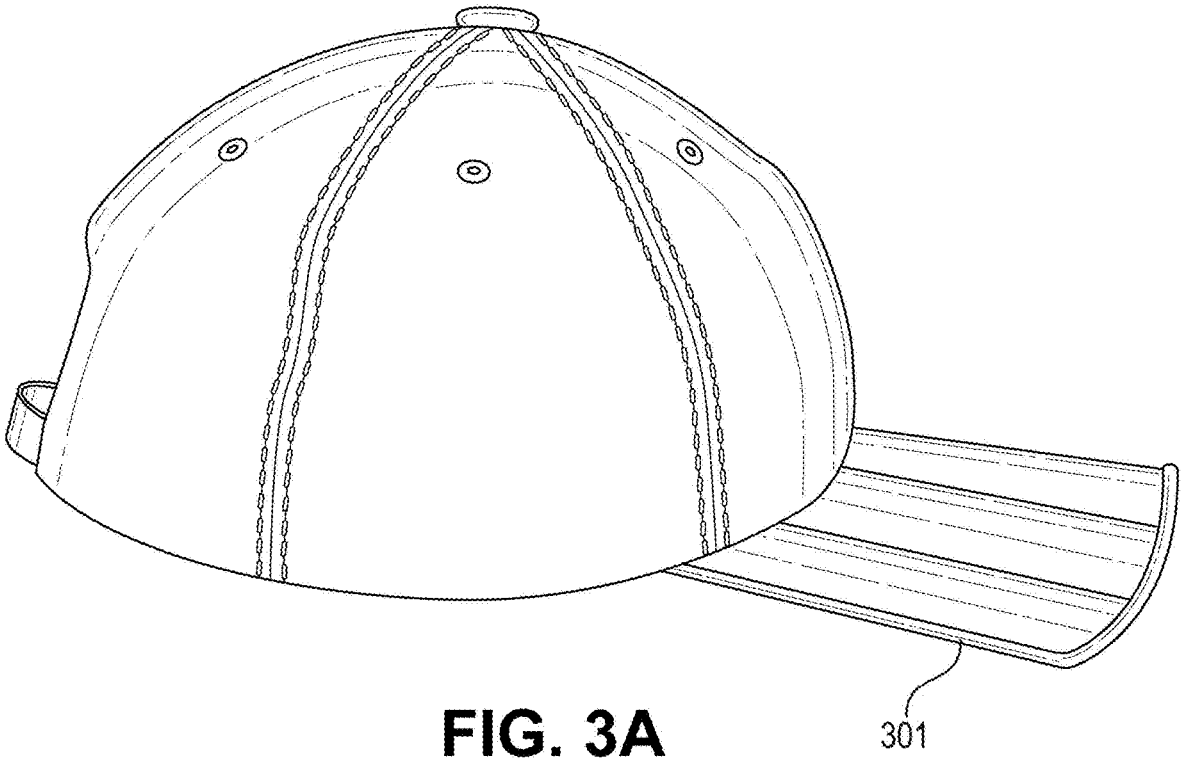
FIGS. 3A and 3B illustrate opposing side views of the cap of FIG. 1 in the unrolled or standard cap configuration.
Figure 3B:
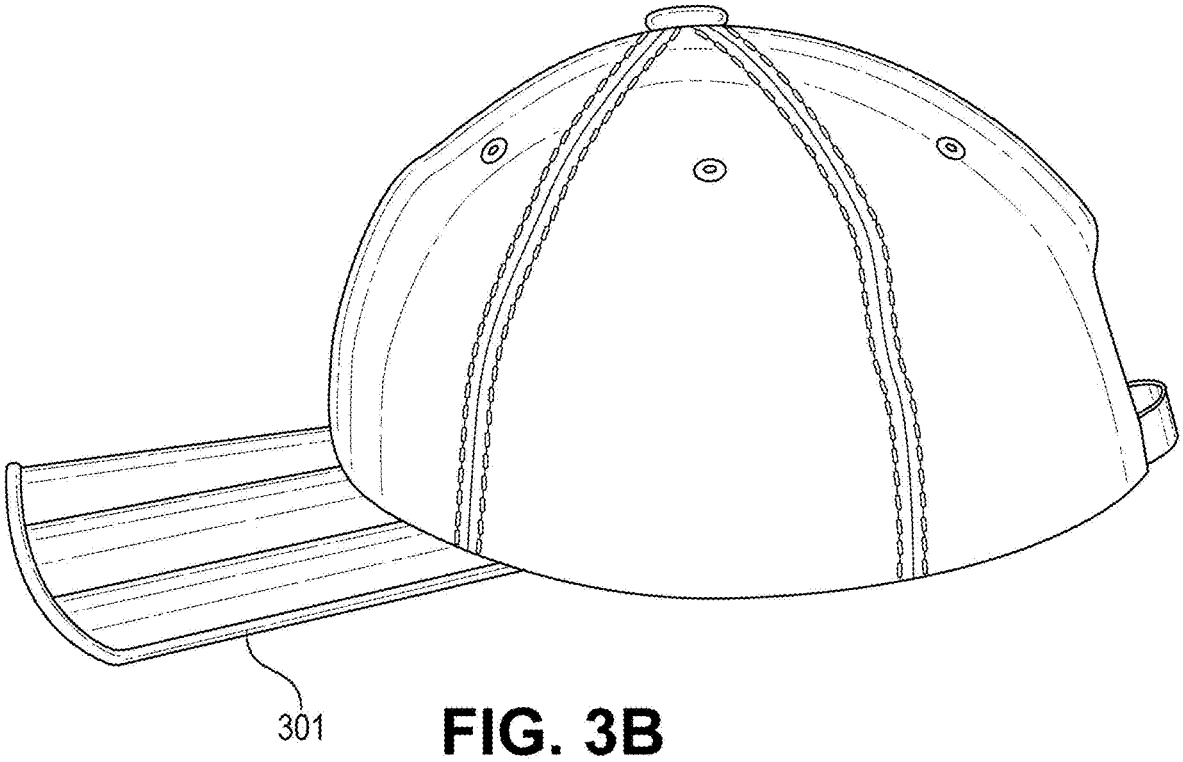

FIGS. 3A and 3B provide opposing side views of the cap in the first state (unrolled). As seen, the bill 301 can be generally flat in this embodiment.

Figure 4A:
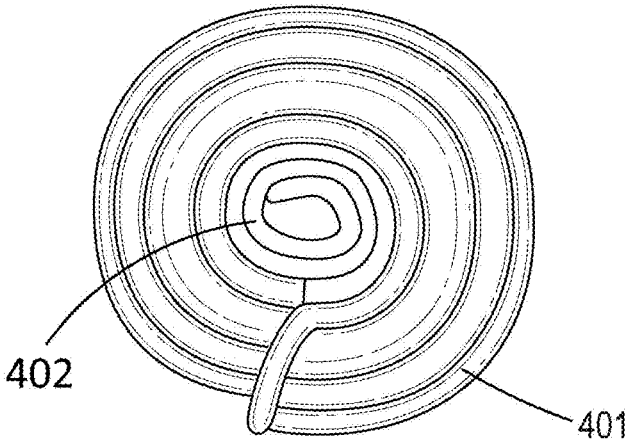
FIGS. 4A and 4B illustrate opposing side views of the cap of FIG. 1 in the rolled configuration.
Figure 4B:
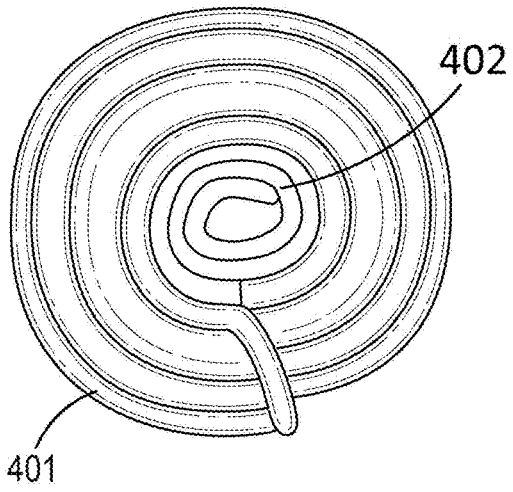

FIGS. 4A and 4B show opposing side view of the cap in the second state (rolled). In this state, the bill 401 can be rolled up with the cap crown 402 tucked inside the rolled bill 401. In alternative embodiments, portions of the crown 402 may not be rolled up in the bill 401.

In one example embodiment, the rollable bill 101, 301, 401 can be made through tempering and high frequency printing sheet metal to form a bistable spring according to the steps below. The embodiment described below is an optional embodiment only, and it should be understood that the bill 101, 301, 401 may also or alternatively be formed with a different number or position of springs, using different adhesives, coatings, or other materials in addition to, but not excluding or limited to, the bistable springs, using different angles and/or bill shapes. Also, the steps may in some instances be performed in a different order and/or comprise more or fewer steps and still be within the scope of the present disclosure.

Step 1. A single flat sheet of metal (such as a 6"×5.35" single flat sheet of metal, for example and without limitation) can be laser cut to desired dimensions. In one example embodiment, the sheet metal can be Grade 304 stainless steel, but any variation of sheet metal or material with the physical capacity to form a bistable spring such as PVC plastic, etc., could be used. Also in an example embodiment, the stainless steel thickness can be between about 0.1 mm and 0.2 mm. However any size thickness could be used as long as it does not prevent the bill from rolling into its rolled form. Additionally, cutting the springs (e.g., the bistable springs) may include any method of doing so and is not limited to laser cutting, bending, using sheet metal shears or scissors, etc. Although example measurements are given here, different angles, lengths, widths, and any other dimensions may also be employed consistent with this disclosure.

Step 2. The sheet metal can be tempered to create a bistable spring effect. The manner of tempering the sheet metal may be any well-known method suitable for the particular type of sheet metal. The process of tempering may also be used to give the sheet metal any desired form or shape. The process of tempering may also be used to create a bistable spring effect in any rollable direction. The process of tempering the sheet metal may be performed at any accessible time, including prior to cutting the sheet metal in step 1. The method of treating the sheet metal to form a bistable spring is not limited to tempering, but may be treated using any well-known method suitable for forming a bistable spring sheet.

Step 3. The bistable spring can be covered in a high frequency coating. In an example embodiment, the coating can be made of silicone, however other coating materials may be used, such as textile, plastic, cloth, leather, etc. It should be understood that while the coating is described as high frequency, alternative methods of coating such as 3D printing, pouring, brushing, sowing, etc., may also be employed consistent with the present disclosure. Coating materials or methods of coating are not limited to single amounts, types of materials or layers, etc. During this stage, raised or lowered imprint forms, designs, lettering, etc. may be implemented onto the bill 101, 301, 401 as long as they do not prevent the bill 101, 301, 401 from rolling into its rolled form. In another embodiment, coating the bill may be entirely or partially omitted, so long as the bill can retain sufficient durability to perform as intended. In another embodiment, a protective edge material such as rubber or PVC tubing may be applied around the front and/or the side edges of the bill prior to step 3.

Step 4. Next, the bill 101, 301, 401 can be connected to the crown 102, 302, 402 of the cap. This can be done with sewing or with an adhesive to an excess coating material in the back of the bill 101, 301, 401. It should be understood, that while the adhering is described as sewing or adhering directly to the coating material, alternative methods of connecting the bill 101, 301, 401, such as adhering to the sheet metal or high frequency coating the sheet metal material and cap material together as one, etc., may be employed consistent with the present disclosure. In one embodiment, a base may be attached to the back of the bill 101, 301, 401 in order to then attach the bill 101, 301, 401 to the crown 102, 302, 402. Such an attachment base may be made out of any compatible material that is consistent with the functionality of the cap. The attachment base may provide additional support to the bill 101, 301, 401 to give it a desired form, structure, etc. The step of attaching the bill to the crown 102, 302, 402 and/or the attachment base itself may alternatively be implemented at any prior step. The attachment base may connected to the crown 102, 302, 402 and the bill 101, 301, 401 using any known method of adhering. In one embodiment, the rollable cap is now complete and ready to wear.

In another embodiment, the rollable bill 101, 301, 401 can be made through joining a series of bistable springs according to the steps below. The embodiment described below is an example embodiment only, and it should be understood that the bill 101, 301, 401 may also or alternatively be formed with a different number or position of springs, using different adhesives, coatings, or other materials in addition to, but not limited to, the bistable springs, using different angles and/or bill shapes. Also, the steps may in some instances be performed in a different order or with more or fewer steps and still be within the scope of the present disclosure.

Step 1. A plurality of curved metal strips (such as, for example, 6 strips) or any material with the physical capacity to form a bistable spring such as PVC plastic, etc., can be cut. In an example embodiment, each of the strips can be about 1" wide (different sized widths can also be used). In an example embodiment, the strips can each be approximately 10" long. Although example measurements are given here, different lengths and/or widths may also be employed consistent with the present disclosure.

Step 2. The metal strips can be bent into the second (rolled) state. For example, using a thin curved edge, such as the neck of a screwdriver, the edge of each metal strip can be gripped and pried backwards to pull on the metal strip so it curls into the desired second or rolled state. This step may need to be repeated from both ends of the metal strips until the desired second position is set. At this point, the metal strips can be bistable springs. Although an example method is described herein, different methods of treating the strips to form the bistable springs, such as tempering, may be employed consistent with the present disclosure.

In some embodiments, it may be necessary to further trim additional material from one end or each end of the bistable springs to ensure that each of the bistable springs has a clean closed circumference in the secondary (rolled) position.

Each strip of bistable spring can then be re-positioned into the primary (unrolled) position whereupon the bend of the original strip can be reinforced or reemphasized. This may be done by bending each bistable spring along the long edges thereof with one's fingers or otherwise through applying force to the long edges. Cutting the springs may include any method of doing so and is not limited to bending, using sheet metal shears or scissors, or using laser cutting technology, etc.

Figure 5A:
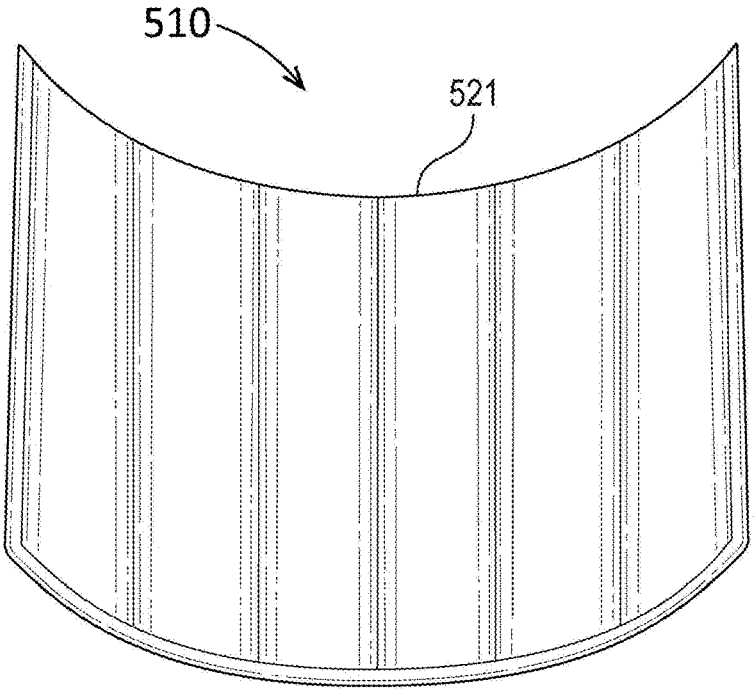
FIG. 5A illustrates a detail top view of a bill construction of one embodiment of the cap in the unrolled or standard cap configuration.
Figure 5B:
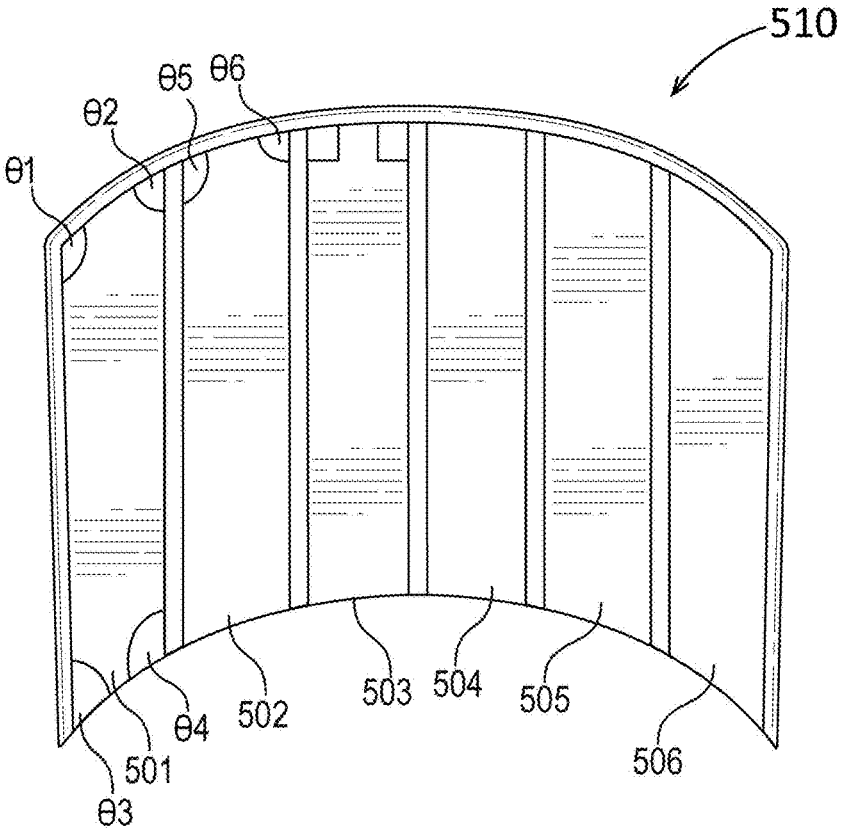
FIG. 5B illustrates a detail top view of the bill construction of one embodiment of the cap in the unrolled or standard cap configuration without bistable springs exposed.
Figure 5C:
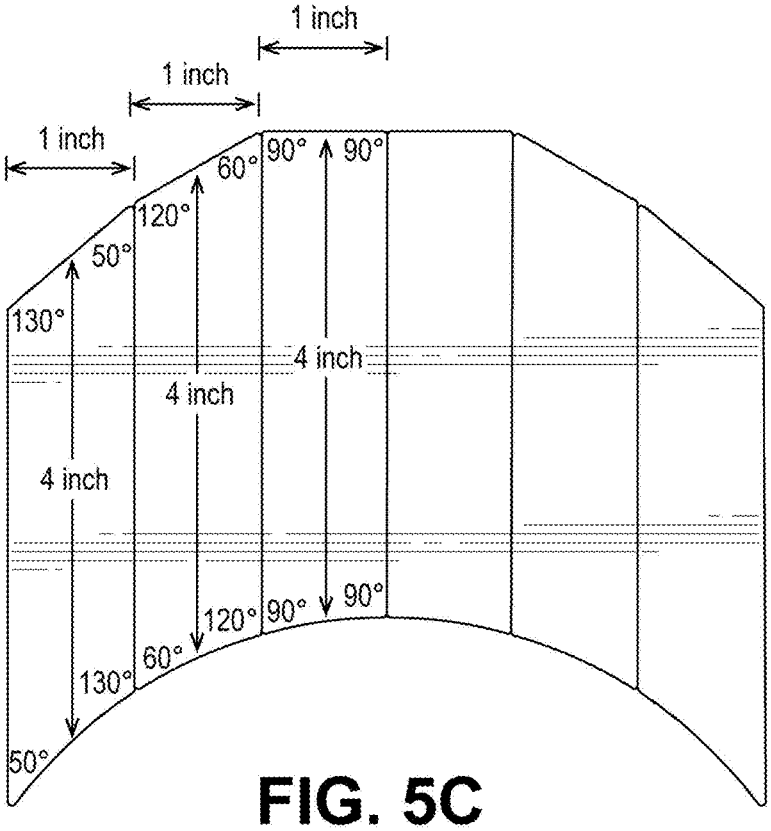
FIG. 5C illustrates a detail of several bistable springs laid out in a cap bill formation.

Step 3. Next, each strip of bistable spring can be measured and cut into the proper shape and length for each strip's location. Each location can have different angled ends. In an example embodiment, as viewed from left to right in FIGS. 5B and 5C, the outer end of a first strip 501 can be cut at roughly a 130 degree first angle (θ1) (i.e., the angle between an imaginary line parallel to an outside lengthwise edge of the strip and a front edge of the strip). The second angle of the outside first strip 501 is cut at roughly a 50 degree angle (θ2). The angles of an inner end of the first strip 501 will exhibit the complimentary angles—i.e., 50 degrees (θ3) and 130 degrees (θ4). Progressing toward the middle of the cap bill 510, each of the angles can move progressively closer to 90 degrees. In the embodiment shown in FIG. 5B, the end of the second strip 502 can be cut roughly at angles of 120 degrees (θ5) and 60 degrees (θ6). The outer ends of the third and fourth strips 503, 504 can be cut at roughly a 90 degree angle (i.e., forming an approximately flat outer edge of the bill 510). The end of the fifth strip 505 can be cut at roughly a 60 degree angle and 120 degree angle (i.e., it is set the same angle as the second strip 502, but with the angle opening to the other direction.) The end of the sixth strip 506 can be cut at roughly a 50 degree angle and 130 angle. Thus, when the strips 501-506 are laid next to each other, the outer ends form the front or outer curvature for the bill 510. Preferably, a depth of the bill 510 (from the front edge thereof to the back edge thereof) can be about 4 inches long at every given point, such that the strips 501-506 can curve along the front edge, and can curve at the same angle on the back (toward the wearer's head) edge. In other aspects, the bill 510 can define any other suitable depth and/or can vary along the depth thereof. FIG. 5C provides an additional view of the example measurements of the bill 510.

The angles described above (θ1, θ2, θ3, θ4, θ5, θ6, etc.) are example dimensions only. In other embodiments, the first and third angles (θ1, θ3) may be between about 110 and 150 degrees; the second and fourth angles (θ2, θ4) may be between about 70 and 30 degrees; the fifth angle (θ5) may be between about 100 and 140 degrees; and the sixth angle (θ6) may be between about 40 and 80 degrees. The angles on the innermost strips (e.g., third and fourth strips 503,504) may not be 90 degrees, but may be adjusted to create a smooth curve along the inner and outer edges of the bill 510. Additionally, rather than cutting the outer and inner ends of each strip 501-506 along a straight line, the ends may being curved at one or both ends. For example, strip 501 may be cut such that the outer edges forming angle θ1 do not form a sharp angle, but are curved. Each other outer and inner edge may also be curved to provide a smooth curve to the bill 510.

Although an example shape of the bill 101, 301, 401, 510 is described above, different angles may be used to create different bill shapes. The example embodiment described above can provide suitable support for structural integrity and fit for the transition between the bill's two positions. Likewise, the depth of the bill 101, 301, 401, 510 could be different sizes, but it has been found that a bill 101, 301, 401, 510 of at least about 4 inches may provide full functionality and stability for use in the first and second positions of the rollable cap described herein. That is, the bill 101, 301, 401, 510 can be cut such that the depth of the bill 101, 301, 401, 510 at each point can be about 4 inches. In other aspects, the depth of the bill 101, 301, 401, 510 can be greater or less than 4 inches. It will also be understood that although six strips 501-506 are shown in this embodiment, more or fewer strips may be used to construct the bill 101, 301, 401, 510. In such a case, the angles for the inner and outer edges of the bill 101, 301, 401, 510 can also be modified accordingly to create a smooth and aesthetically pleasing inner and outer curvature of the bill 101, 301, 401, 510.

Step 4. Next, the strips of bistable springs 501-506 can be adhered to each other to make a sheet of bistable springs. In an example method, the uncoated sheets of connected bistable springs 501-506 can be placed in their intended unrolled positioned, then bonded or glued together and may also be reinforced with an adhesive-sprayed sheet of plastic or tape on the top side as further described below. Alternatively, the strips 501-506 may be bonded together with only a reinforced layer of adhesive-sprayed sheet of plastic or tape, without an initial or finishing bonding or adhesive. At the front edge of the strips 501-506, the same tubing 104 as previously described can be used as a bumper for the springs 501-506 to keep them in place vertically. The springs 501-506 can be rested on top of a tray in their positions, sprayed with adhesive and then a plastic reinforcement sheet can be placed on top. The reinforcement layer or layers may be made of a flexible sheet of any primary coating material, for example and without limitation.

In an example method, B-6000 and Super 77 spray adhesive can be used, but other adhesives may be substituted. In alternative embodiments, the springs 501-506 may be positioned in any variation including, but not limited to, front to back otherwise described as vertical while right side up, side to side otherwise described as horizontal while right side up, upside down either vertical or horizontal, alternating the strips 501-506 upside down and right side up either vertical or horizontal. Dimensions and angles of the springs 501-506 may be modified as needed to give a desired shape depending on an alternative positioning of the springs 501-506.

Step 5. Next, the bond between the strips 501-506 can be reinforced by spraying the top sides of the now-joined series of strips 501-506 with an adhesive and applying a thin plastic layer over them. In one embodiment of this method, cellophane or common kitchen plastic wrap may be used. However, other flexible materials may also be substituted here without departing from the scope of the present disclosure. In another embodiment, the strips 501-506 may be connected using a large sheet of duct tape in place of a top layer reinforcing plastic sheet and then trimming off the excess around the edges. This alternative method may improve the ease of constructive use.

Figure 10:
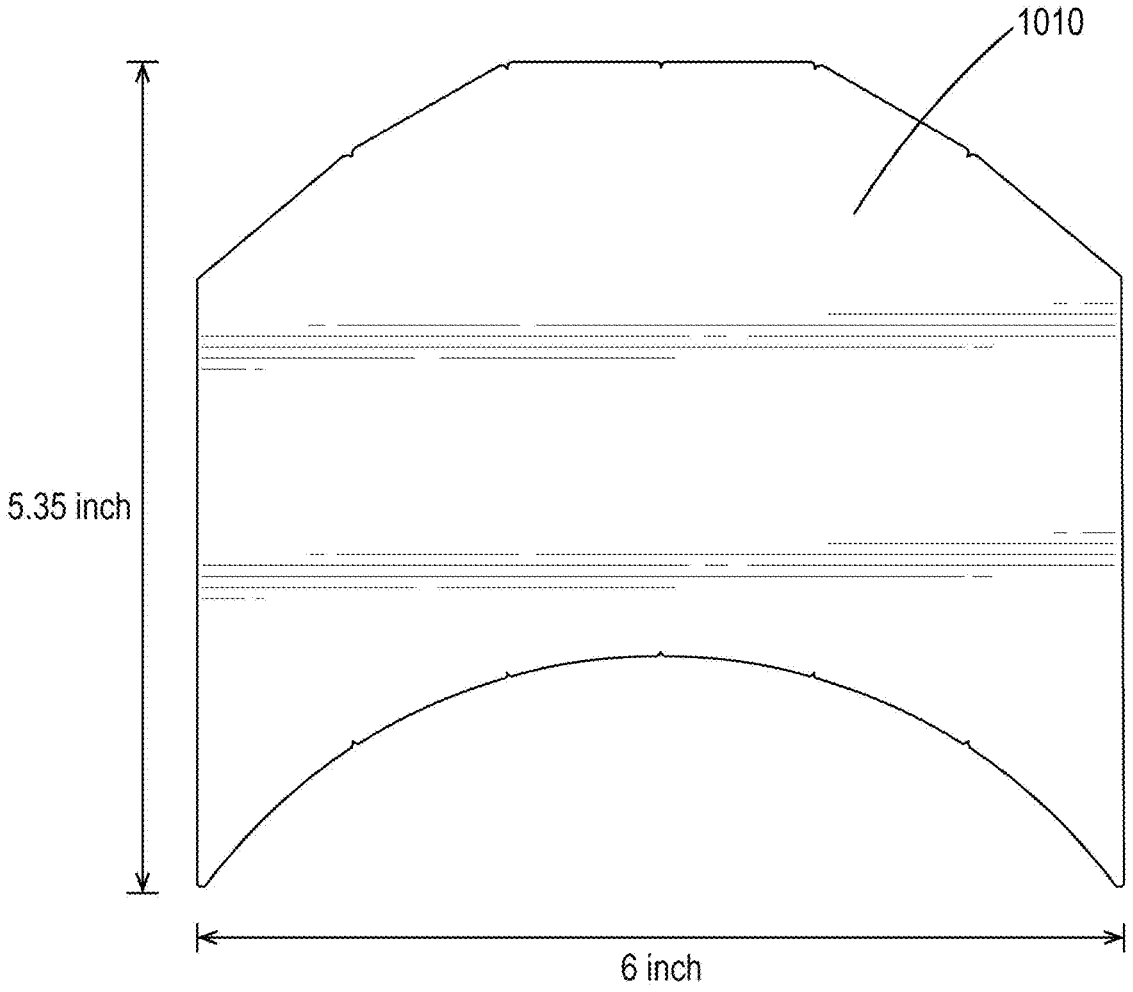
FIG. 10 illustrates an example aspect of a spring for a bill of the cap comprising a single bistable spring.

It may also be possible to skip step 4 if a different high quality adhesive substance is used; for example a large/wide single sheet of tape in place of adhering each strip 501-506 separately along the edges. Alternatively, the strips 501-506 could be joined in other ways, such as by welding, magnetism, etc. or a single very wide bistable spring sheet 1010 (as shown in FIG. 10) may be used in place of the strips 501-506.

A thin coating may also (or alternatively) be applied to the underside of the bill 101, 301, 401, 510.

Step 6. The tubing 104 can next be applied to reinforce the front and side edges of the bill 101, 301, 401, 510. This can be done by measuring out a length of thin tubing 104, cutting a straight slit along one side of the tubing 104 from end to end, then putting the edge of the bill 101, 301, 401, 510 inside the open slit of the tubing 104, and then gluing the tubing 104 along the edges where it meets the bill 101, 301, 401, 510. Finally, any excess tubing 104 can be trimmed. The protective edge component 104 may be made out of any protective material that is consistent with the present disclosure.

The tubing 104 can be applied along the sides of the bill 101, 301, 401, 510 to provide additional protection from the sharp edges of the metal springs 501-506 and for aesthetic purposes. In an example embodiment, the front tubing 104 can be used to prevent the springs 501-506 from separating along the front ends, providing additional protection from the sharp edges of the metal springs 501-506, and for aesthetic purposes. However, in some aspects, even the front and side tubing 104 might be omitted if a sufficiently strong top layer is used that prevents separation of the front edge.

Step 7. Next, the base (such as a plastic base) can be created for the back edge of the bill 101, 301, 401, 510. In the preferred method, this is done by placing a plastic strip 521 along the back side of the strips 501-506, as shown in FIG. 5A. The base strip 521 can be inserted along the back of the bill 101, 301, 401, 510. The insert line may be most optimal if it follows the natural curvature of the bill 101, 301, 401, 510 when it is in the first (unrolled) position as in FIG. 5A.

Although the base strip 521 is described as being plastic, any flexible or malleable material with structural integrity can be used for this base, such as plastic, rubber, leather or sufficiently thick fabric materials, etc. Any suitable polymer or other flexible materials known in the art may also be used with the cap of the present disclosure, so long as they are not too flexible or too stiff and thus incapable of rolling or holding the bill 101, 301, 401, 510 up properly in the unrolled position.

Step 8. Next, the base strip 521 can be connected onto the back edge of the bill 101, 301, 401, 510 and trimmed as needed. In an example embodiment, the back end of the bill 101, 301, 401, 510 can be inserted into the insert line of the base strip 521 and joined onto the back end of the bill 101, 301, 401, 510. In one embodiment, the bill 101, 301, 401, 510 and base strip 521 may be joined by melting or heating the materials and welding or soldering the materials together. The connection can then be reinforced in some aspects using an adhesive. Although in other aspects, adhesive alone can be used, or heating/melting alone can be used. Additionally, applying an adhesive at the insertion line and along the back edge of the bill 101, 301, 401, 510 prior to the soldering process is another potential option. Connecting the base strip 521 to the bill 101, 301, 401, 510 is not limited to the methods described above, but may be accomplished via any alternative method such as tape, molding, etc.

After the base strip 521 is connected to the bill 101, 301, 401, 510 and the glue is dry, the base strip 521 can be trimmed as needed to smooth out the shape and make it flush with the crown 102, 302, 402 of the cap. In one embodiment, perpendicular slits may be cut into the top of the base strip 521 at the bistable spring connection points to allow for maximum flexibility in the base strip 521 for when the bill 101, 301, 401, 510 transitions into the second position and for flexibility when it is being worn in the first position. In other aspects, this modification of trimming/cutting the base strip 521 can be done prior to connecting it to the bill 101, 301, 401, 510.

Figure 5D:
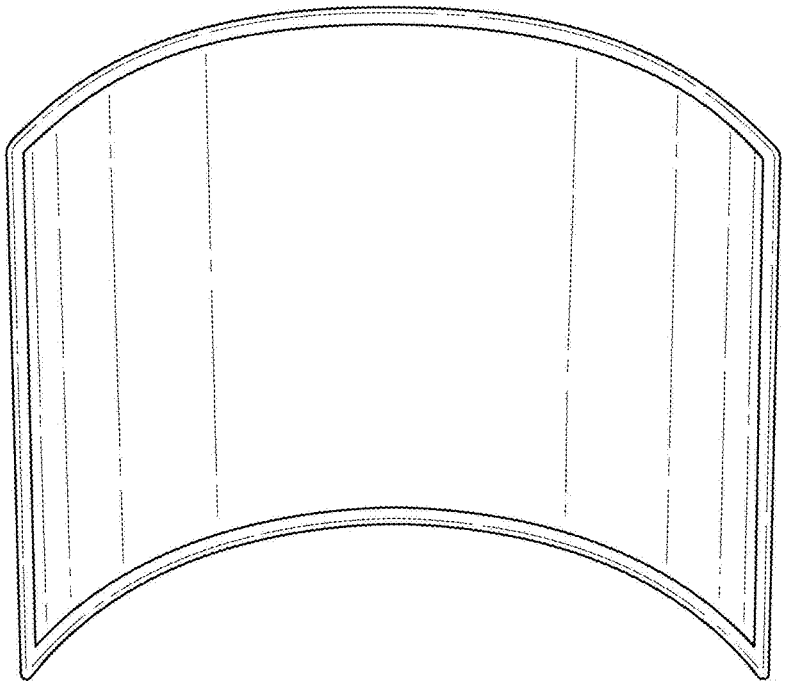
FIG. 5D illustrates the formed bill of the cap with a coating and edging applied.

Step 9. The bill 101, 301, 401, 510 can next be coated in a protective material. In an example embodiment, (as shown in FIG. 5D) silicone may be used to improve appearance, function, and cleanliness, but any number of suitable outer coating materials might be used. In an example embodiment, application may done by masking the base strip 521 (such as with tape, for example), and pouring silicone onto the bill 101, 301, 401, 510 while the bill 101, 301, 401, 510 rotates to keep an even coating. However, the coating can also be applied with a brush, spray, high frequency or 3D printing, or by dipping the bill 101, 301, 401, 510 into the coating, etc. In an alternative embodiment, the bill 101, 301, 401, 510 may be inserted into a mold and silicone (or other coating) can be applied to coat the bill 101, 301, 401, 510. Coating materials or methods of coating are not limited to single amounts, types of materials, or layers, etc. In alternative embodiments, the protective materials may be omitted entirely or partially, so long as the bill 101, 301, 401, 510 can retain sufficient durability to perform as intended.

Step 10. Next, the bill 101, 301, 401, 510 can be connected to the crown 102, 302, 402 of the cap. This can be done with sewing or with an adhesive, for example and without limitation. In one embodiment, the rollable cap is now complete and ready to wear.

In another embodiment, the bill 101, 301, 401, 510 may be comprised of a bistable spring sheet or bistable springs 501-506 without any prior reinforcement to being coated or covered in one or more outer materials. Such an outer material may be produced with an injection mold, adhering or sewing individual strips of pockets together, etc. Coating materials or methods of coating are not limited to single amounts, types of materials, or layers, etc. In one embodiment, the coating exterior may be made independently or prior to coating the bistable spring sheet or bistable springs 501-506, and the springs 501-506 may be inserted into the coating exterior structure to form the bill 101, 301, 401, 510. Additional adhesive may be used at any time during this process for extra stability. Protective edging material 104 may be installed for additional protection and stability. The bill 101, 301, 401, 510 can then be attached to the crown 102, 302, 402 using any form of adhering, adhesive or sewing, etc.

In another embodiment, the cap material and coating material may be the same and may not need to be connected as the two materials would already be pre-flowing into the other. An internal bistable spring sheet or a plurality of bistable springs 501-506, components or structures, etc., could then be inserted and stabilized via methods of adhesive, sewing, etc, for example and without limitation.

In another embodiment, the cap may also comprise an adjustable back-strap fastening feature, as described below. Although the adjustable back-strap fastening feature can be designed to be possibly used with the rollable cap described herein, it may also be used with any other variations of traditional or commonly known caps.

Figure 8A:
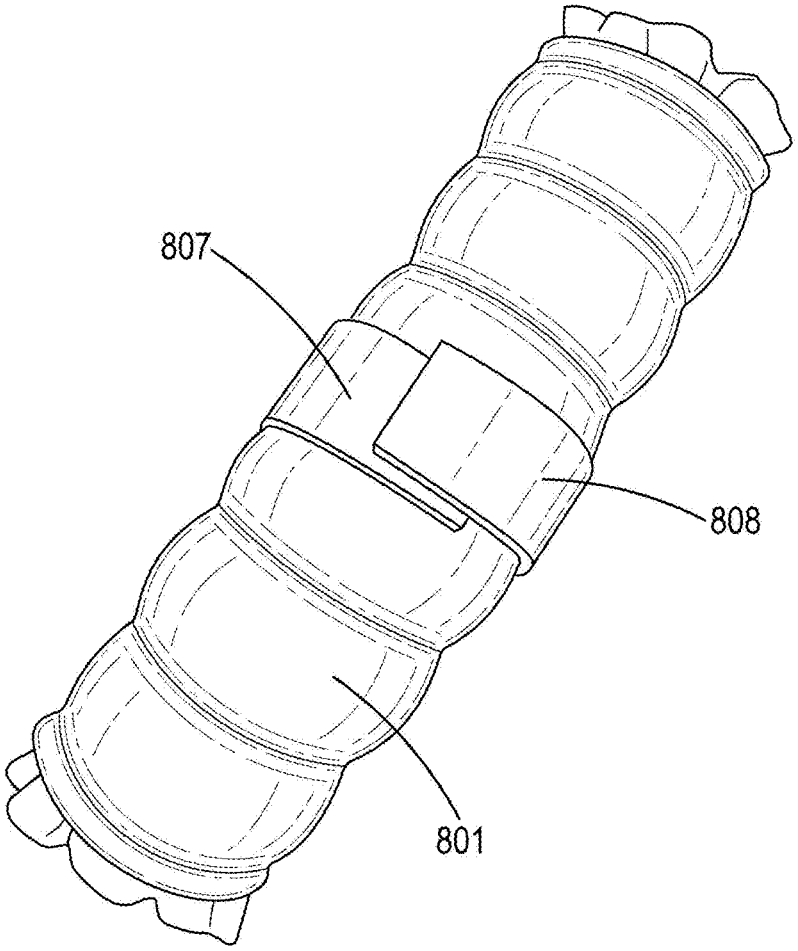
FIGS. 8A-8C illustrate example aspects of the cap comprising an adjustable back-strap fastening feature, according to another example aspect of the present disclosure.
Figure 8B:
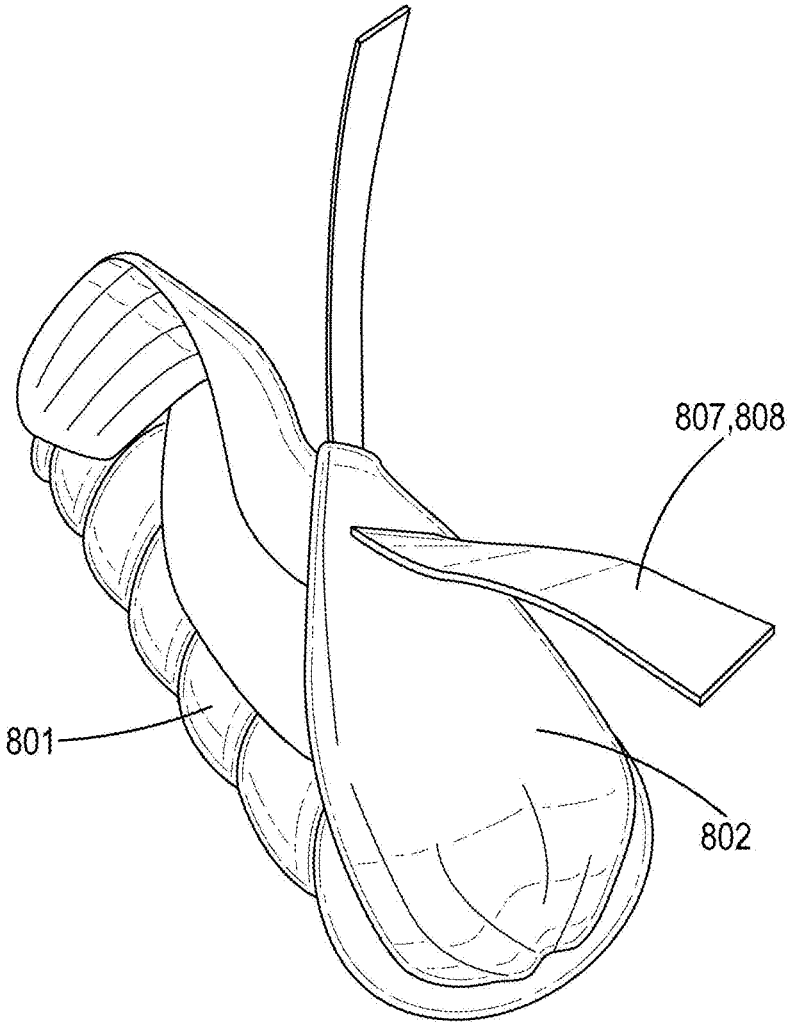
Figure 8C:
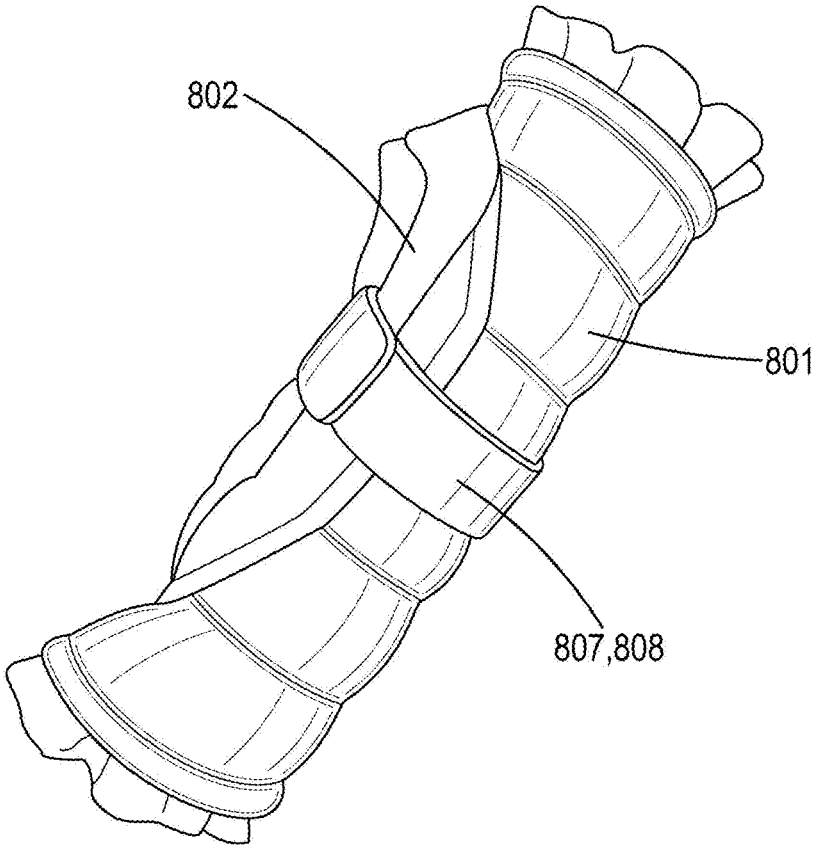
Figure 9A:
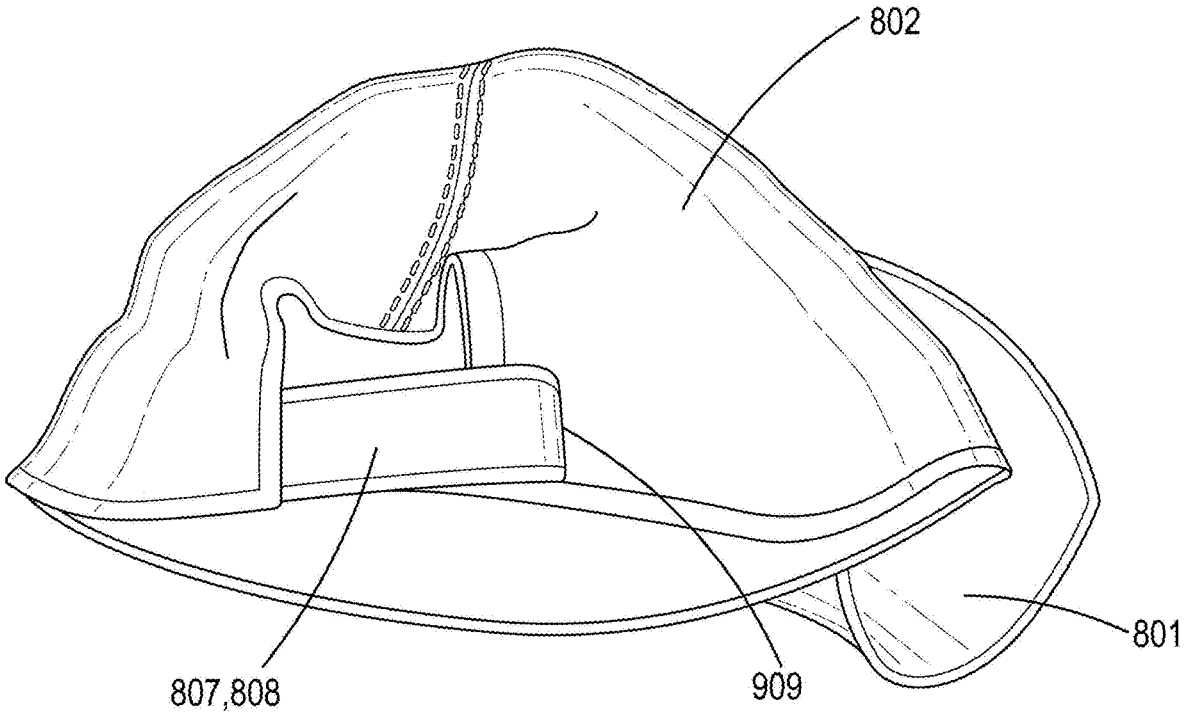
FIGS. 9A-9D illustrate example aspects of the cap comprising the adjustable back-strap fastening feature, according to another example aspect of the present disclosure.
Figure 9B:
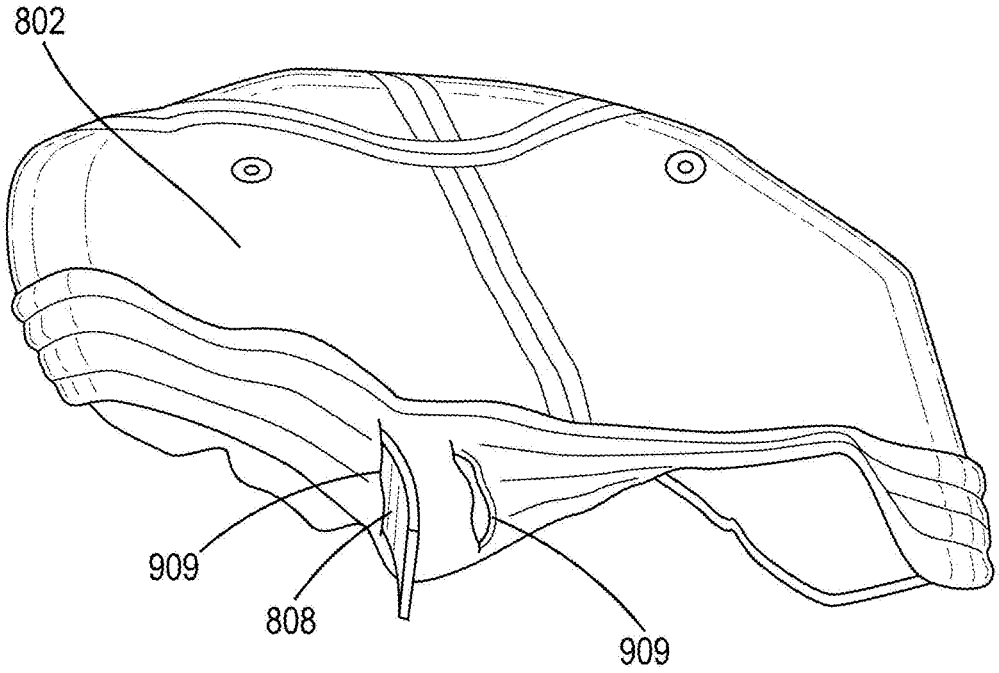
Figure 9C:
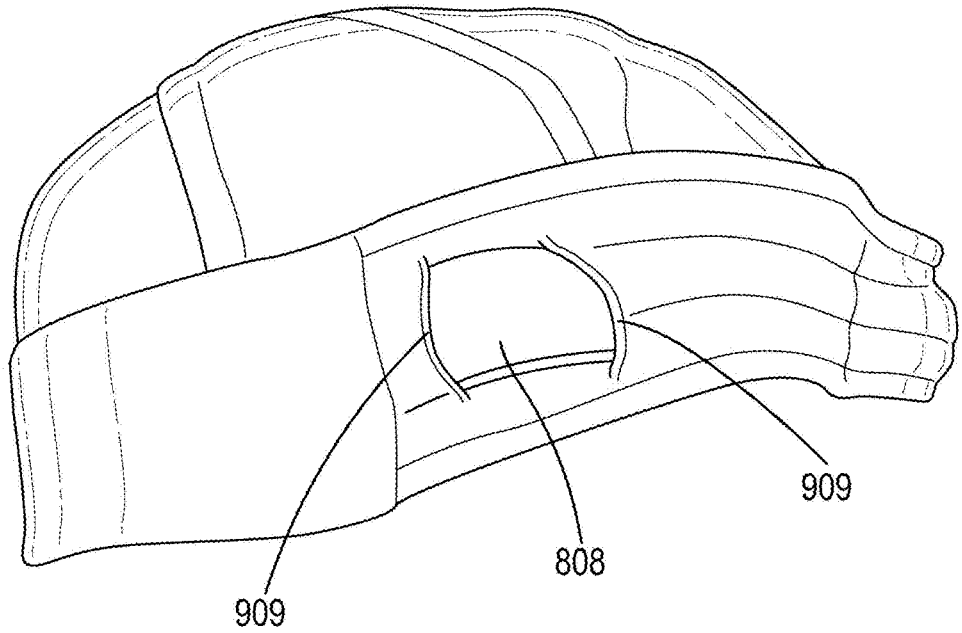
Figure 9D:
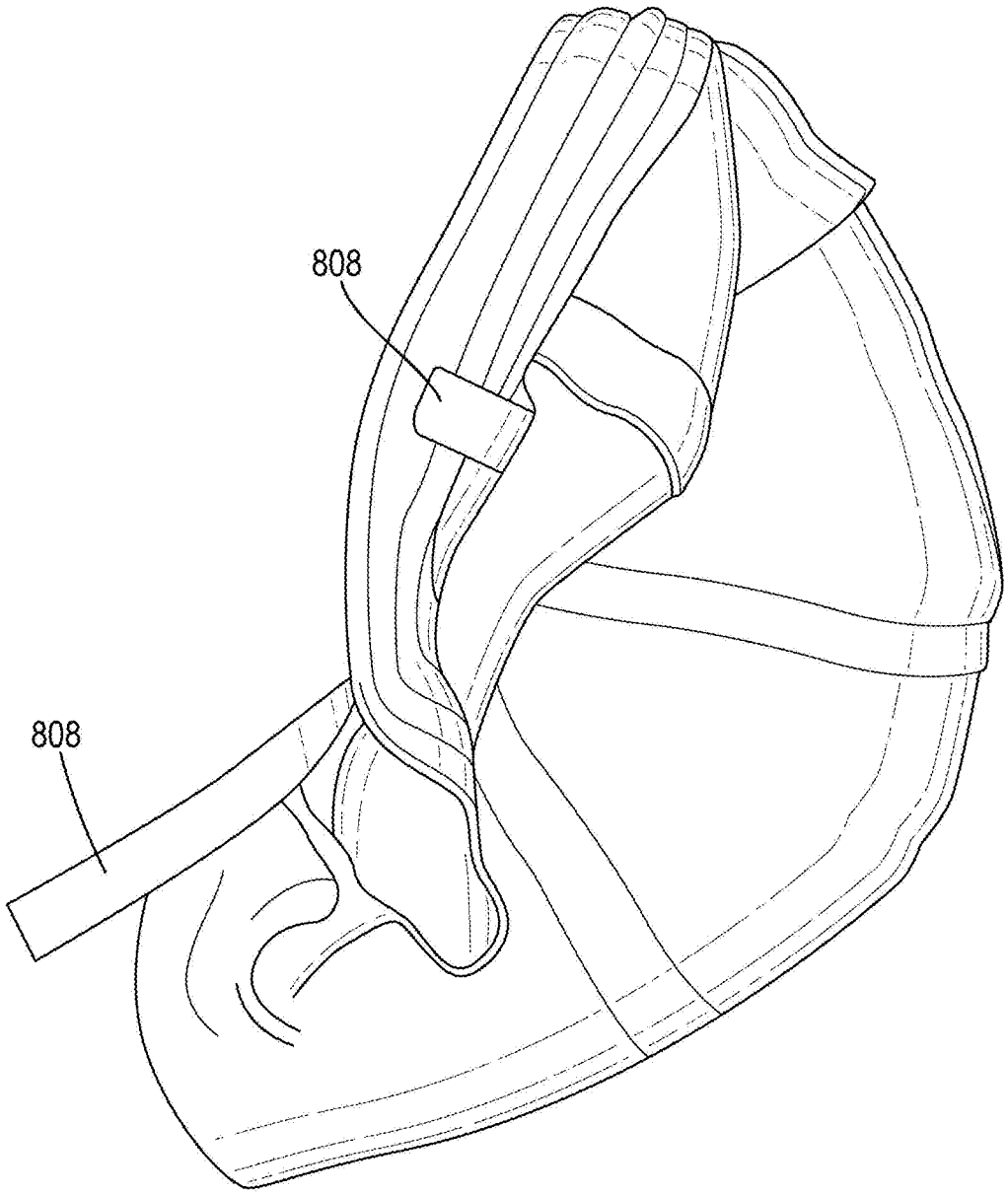

Example aspects of the adjustable back-strap fastening feature 807 is depicted in FIGS. 8A, 8B, 8C, 9A, 9B, 9C, and 9D. As shown in FIGS. 8A-8C, in the example aspect depicted herein, the back-strap fastener feature 807 can comprise one or more back-straps 808 that can be wrapped around the cap (including the bill 801 and the crown 802) and secured in the wrapped configuration to retain the cap in the rolled state. As shown in FIGS. 9A-9D, one or more uniquely positioned, weaving-ready, back-strap insert holes 909 may be added on the rear or side of the crown 802 to provide a novel manner of concealing the excess of the top back-strap 808. In this embodiment, the top back-strap 808 may be lengthened to be multi-utilized, in addition to securing the fit of the cap's crown 802 when it is in use, the top back-strap 808 can also be interlaced through the main back-strap insert hole(s) 909 and then the top back-strap 808 can easily wrap around and secure a tighter close of the rolled bill 801 when in a stored, cap enclosure position. The top back-strap 808 may be secured using a variety of methods including, but not limited to, VELCRO® (i.e., hook and loop fasteners), snaps, slides, etc.

In another embodiment, the cap may also comprise an adjustable back fastening feature, as described below. Although the adjustable back fastening feature is designed to be possibly used with the rollable cap described herein, it may also be used with any other variations of traditional or commonly known caps.

Figure 6A:
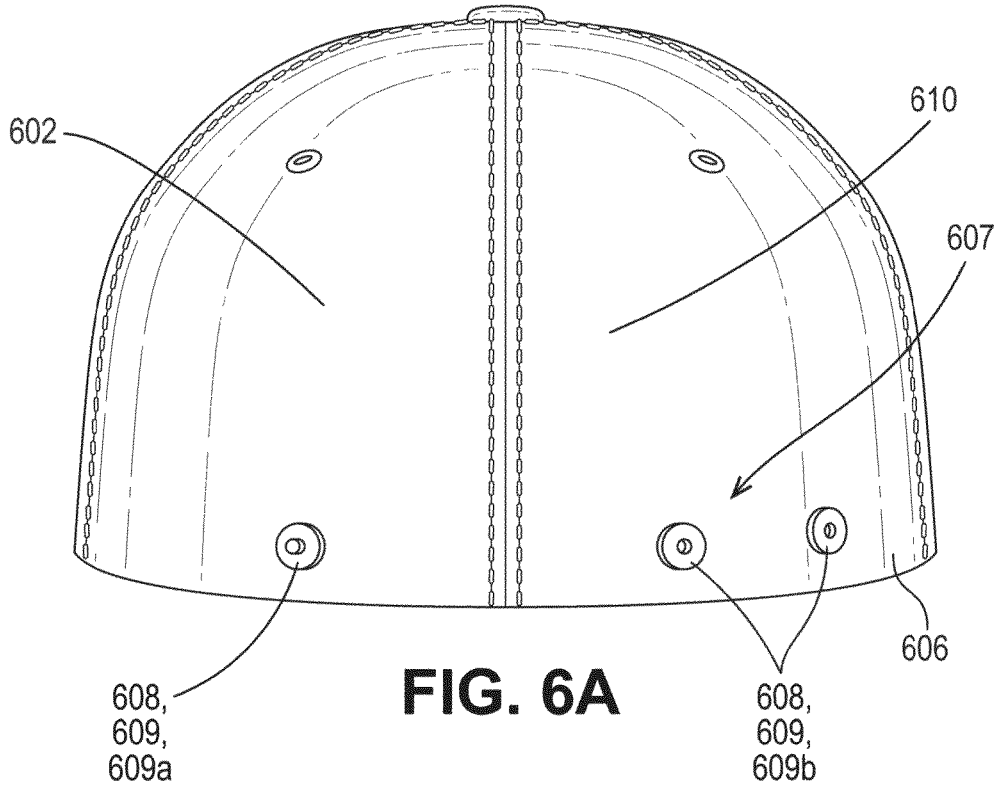
FIG. 6A illustrates a rear view of one embodiment of the cap showing adjustable fasteners in an open or unfastened configuration.
Figure 6B:
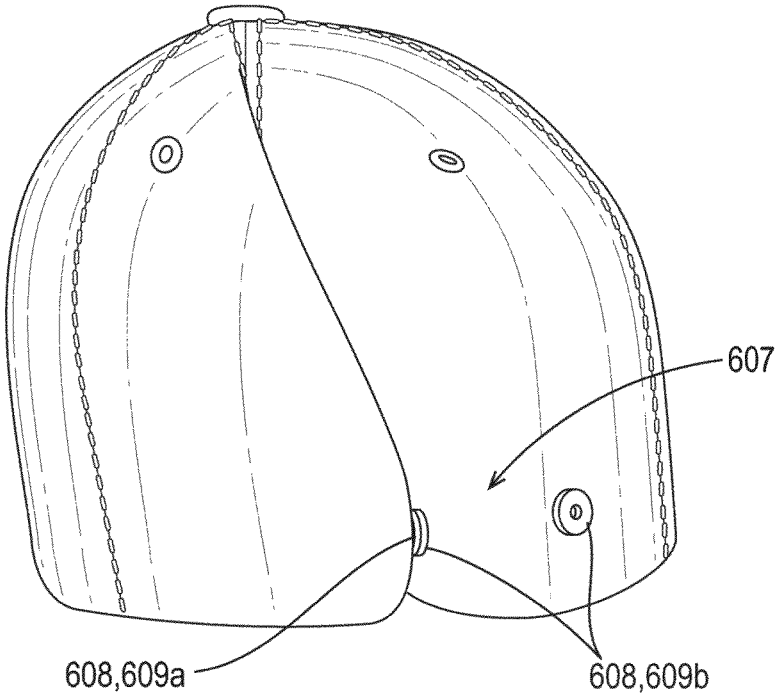
FIG. 6B illustrates a rear view of the cap of FIG. 6A showing the adjustable fasteners in a fastened configuration.

The adjustable back fastening feature 607 is depicted in FIGS. 6A and 6B. In an example embodiment and method, fasteners 608 such as buttons or snaps 609 can be attached to a back side 610 of the crown 602 along the sweatband brim area 606. The manner of attaching the adjustable back fastening feature 607 to the cap may be any well-known method suitable for the particular type of fastener used. In an example embodiment, the fasteners (e.g., the buttons or snaps 609) can be installed with a pressing tool. The fasteners 608 may be affixed off to one side of the back side 610 of the cap (as seen in FIGS. 6A and 6B, as opposed to centering the fasteners 608 on the back side 610 of the cap. The fastener(s) 608 needs not be located directly at the back side 610 of the cap, but can be slightly offset as a style choice or located at any point on the cap that is not where the bill 101, 301, 401, 510 is located. In an example embodiment using the snaps 609, as shown, the cap can comprise one male snap 609*a* and one or more female snaps 609*b* to allow for multiple size adjustments.

Figure 7A:
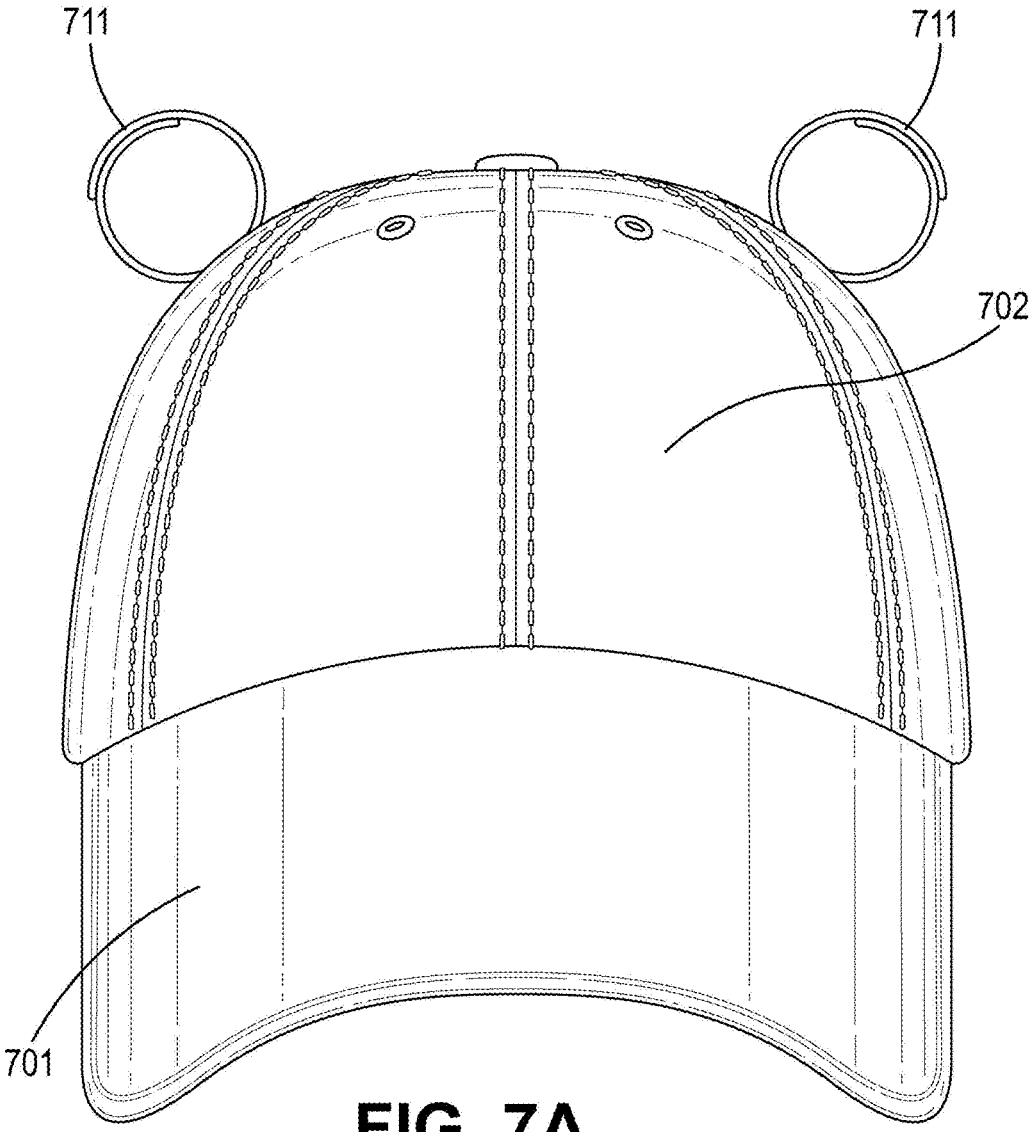
FIGS. 7A and 7B illustrate an alternative embodiment of the cap with bistable springs located in the crown of the cap.
Figure 7B:
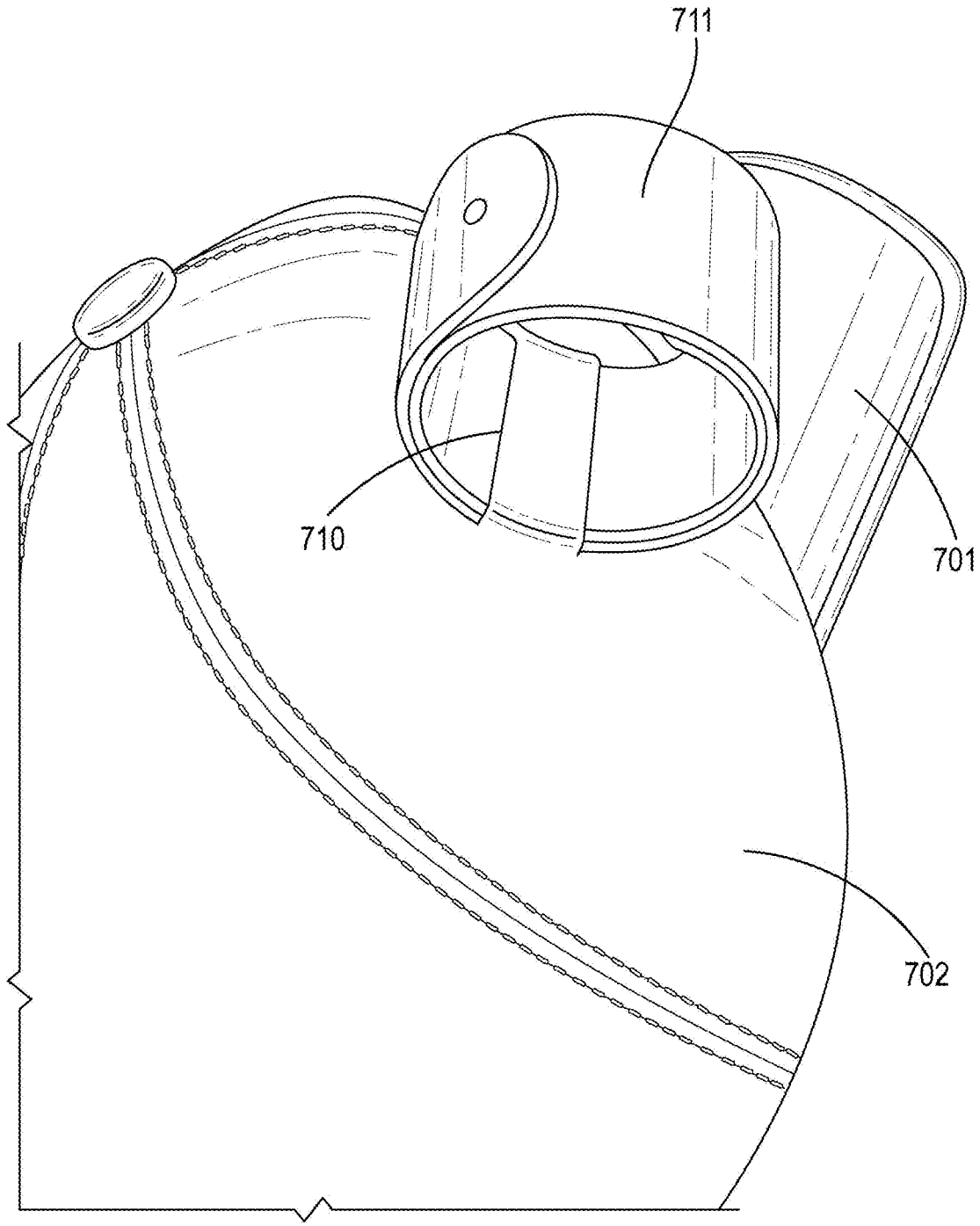

In another example embodiment, two pairs of slits 710 (shown in FIG. 7B) may be cut into a top side of the crown 702 on each opposing lateral side thereof, with removable closed bistable spring strips 711 inserted lengthwise along the cap into those slits 710, thereby creating an "animal ears" effect in the cap, as depicted in FIGS. 7A, 7B. This may be incorporated into a cap with or without the rollable bill 701.

In another example embodiment, the rollable bill 101, 301, 401, 510, 701, 801 may be incorporated into a visor or cap without a full crown 102, 302, 402, 602, 702, 802. In another embodiment, the rollable bill 101, 301, 401, 510, 701, 801 may be split into two or more pieces, such that, for example, the left side of the bill 101, 301, 401, 510, 701, 801 may be rolled up and the right side of the bill 101, 301, 401, 510, 701, 801 may remain unrolled, or vice versa. In another embodiment, the rollable bill 101, 301, 401, 510, 701, 801 may be implemented into bills of alternative hat and cap structures such as cowboy hats, sun-hats, etc.

In one example embodiment, the cap described herein may be worn with the bill 101, 301, 401, 510, 701, 801 in the rolled position. In one embodiment, when worn in the rolled position, the bill 101, 301, 401, 510, 701, 801 may be used to hold various items such as canned or bottled beverages, or any goods with sufficient durability and shape to fit into the rolled bill 101, 301, 401, 510, 701, 801 without being crushed.

FIG. 10 illustrates an example aspect of the single bistable spring 1010, showing potential dimensions thereof. The dimensions shown in FIG. 10 are merely examples and should not be viewed as limiting.

While certain embodiments have been provided and described herein, it will be readily apparent to those skilled in the art that such embodiments are provided by way of example only. It should be understood that various alternatives to the embodiments described herein may be employed, and are part of the disclosure described herein.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of illustrated embodiments of the system, methods, or devices are not intended to be exhaustive or to be limited to the precise form disclosed. While specific embodiments of, and examples for, the system, methods, or devices are described herein for illustrative purposes, various equivalent modifications are possible within the scope of the system, methods, or devices, as those skilled in the relevant art will recognize. The teachings of the system, methods, or devices provided herein can be applied to other processing systems, methods, or devices, not only for the systems, methods, or devices described.

The elements and acts of the various embodiments described can be combined to provide further embodiments. These and other changes can be made to the system in light of the above detailed description.

In general, in the following claims, the terms used should not be construed to limit the system, methods, or devices to the specific embodiments disclosed in the specification and the claims, but should be construed to include all processing systems that operate under the claims. Accordingly, the system, methods, and devices are not limited by the disclosure, but instead the scope of the system, methods, or devices are to be determined entirely by the claims.

While certain aspects of the system, methods, or devices are presented below in certain claim forms, the inventors contemplate the various aspects of the system, methods, or devices in any number of claim forms. Accordingly, the inventors reserve the right to add additional claims after filing the application to pursue such additional claim forms for other aspects of the system, methods, or devices.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A cap comprising:

a crown; and a bill comprising one of a sheet of flat metal formed as a bistable spring sheet or a plurality of strips of flat metal formed as a plurality of bistable springs, the bistable spring sheet or each of the plurality of bistable springs configurable in a first stable state and a second stable state, the bill defining a back edge connected to the crown and a front edge opposite the back edge;

wherein, in a first position of the cap, the one of the bistable spring sheet or each of the plurality of bistable springs are unrolled in the first stable state and the bill is in an extended configuration, and in a second position of the cap, the one of the bistable spring sheet or each of the plurality of bistable springs are rolled up in the second stable state and the bill is in a rolled configuration; and wherein, in the second position of the cap, the front edge of the bill is rolled towards the back edge of the bill in a front-to-back direction.

2. The cap of claim 1, wherein the one of the bistable spring sheet or the plurality of bistable springs are coated on at least one of a top surface or a bottom surface with a protective material.

3. The cap of claim 2, wherein the protective material comprises silicone.

4. The cap of claim 1, wherein the one of the bistable spring sheet or the plurality of bistable springs are surrounding along an outer edge with a protective material.

5. The cap of claim 4, wherein the protective material comprises one of a rubber tubing or a PVC tubing.

6. The cap of claim 1, wherein the bill is adhered to the crown by an adhesive.

7. The cap of claim 6, further comprising an attachment base attached to a back of the bill and adhered to a front of the crown.

8. The cap of claim 1, wherein:

the bistable spring sheet or each of the plurality of bistable springs remain naturally in the first stable state until an outside force acts upon the bistable spring sheet or each of the plurality of bistable springs to change the bistable spring sheet or each of the plurality of bistable springs to the second stable state; and the bistable spring sheet or each of the plurality of bistable springs remain naturally in the second stable state until an outside force acts upon the bistable spring sheet or each of the plurality of bistable springs to change the bistable spring sheet or each of the plurality of bistable springs to the first stable state.

9. The cap of claim 1, wherein the bill defines a natural curvature in a side-to-side direction, and wherein the front-to-back direction is perpendicular to the side-to-side direction.

10. The cap of claim 1, wherein the bill comprises the plurality of the bistable springs, and wherein each of the bistable springs extends from the front edge of the bill to the back edge of the bill.

11. The cap of claim 1, wherein:

the bistable spring sheet or each of the plurality of bistable springs are configurable only in the first stable state and the second stable state;

the first stable state is an unrolled state and the second stable state is a coiled state; and in the unrolled state, a curvature of the bistable spring sheet or each of the plurality of bistable springs is in an opposite direction than the curvature in the coiled state.

* * * * *